United States Patent [19]

Wetmore et al.

[11] 4,198,110

[45] Apr. 15, 1980

[54] CONNECTOR

[75] Inventors: Harold B. Wetmore, Needham; Robert A. Harrow, Sudbury; William C. Holway, Acton, all of Mass.

[73] Assignee: General Energy Development Corp., Needham, Mass.

[21] Appl. No.: 913,645

[22] Filed: Jun. 8, 1978

[51] Int. Cl.[2] ..... H01K 13/30; H01R 13/44

[52] U.S. Cl. ..... 339/89 R

[58] Field of Search ..... 339/89 R, 89 M, 89 C, 339/90 R, 90 C, 65, 75 R, 75 M, 61 R, 61 M, 66 R, 66 T, 66 M, 184 R, 184 M, 184 C, 184 L, 60 M, 60 C, 60 R, 91 B, 89

[56] References Cited

U.S. PATENT DOCUMENTS

| | | | |
|---|---|---|---|
| 2,521,822 | 9/1950 | Boswell | 339/89 R X |
| 3,066,272 | 11/1962 | Quackenbush | 339/89 X |
| 3,090,937 | 5/1963 | Keith | 339/89 X |
| 3,305,249 | 2/1967 | Zahuranec | 339/89 R |
| 3,609,637 | 9/1971 | Cole | 339/75 R |
| 3,783,434 | 1/1974 | Ransford | 339/60 C |
| 3,789,346 | 1/1974 | DeBrick | 339/89 R |
| 3,855,566 | 12/1974 | Richardson | 339/89 M X |
| 3,930,705 | 1/1976 | Gallagher | 339/184 M X |
| 4,090,759 | 5/1978 | Herrmann | 339/60 M |

*Primary Examiner*—Joseph H. McGlynn
*Assistant Examiner*—John S. Brown
*Attorney, Agent, or Firm*—Wolf, Greenfield & Sacks

[57] ABSTRACT

An explosion-proof connector of the dual envelope type having an inner waterproof neoprene connector assembly including a plug and receptacle contained in an outer explosion-proof housing including separate housing parts for the plug and receptacle. Wires of each cable connector respectively to mounting pins of the plug and receptacle and the assembled connector assembly is inserted, keyed, and locked into the outer housing with the use of at least a locking sleeve.

8 Claims, 4 Drawing Figures

CONNECTOR

BACKGROUND OF THE INVENTION

The present invention relates in general to connectors and is concerned, more particularly, with explosion-proof connectors of relatively simple construction. The connector of this invention is described in connection with use in a hazardous area such as use in a coal mine. However, it is understood that the principles of this invention may also be used in constructing connectors for other applications.

One object of the present invention is to provide an improved explosion-proof connector for a multi-wire cable.

Another object of the present invention is to provide an explosion-proof connector that is small, lightweight, and also water-proof.

A further object of the present invention is to provide an improved connector preferably of the dual envelope type including an inner water-proof neoprene connector contained in an outer explosion-proof housing.

Still another object of the present invention is to provide an explosion proof connector that is of relatively simple construction using readily-available components and which is easy to assemble in the field. Because of the simplicity of the connector of this invention it may also be used as an inexpensive means for splicing or repairing a cable. This is of significant advantage especially in the environment of a coal mine where large machinery is used and where many times cables become broken or damaged.

SUMMARY OF THE INVENTION

To accomplish the foregoing and other objects of this invention there is provided an explosion-proof connector for coupling to sections of a multi-wire cable. The connector is of the dual envelope type comprising an inner water-proof connector assembly including an insulative receptacle for supporting male pins coupling to the wires of one section of the cable and an insulative plug for supporting female members coupling to the wires of another section of the cable. After this inner assembly is connected with the cable sections it is inserted, keyed, and locked into an outer explosion proof housing which comprises a receptacle housing for receiving the insulative receptacle and a plug housing for receiving the insulative plug. Individual means are provided for locking the receptacle in the receptacle housing and also for locking the plug in the plug housing. Both the receptacle and plug are locked in a fixed predetermined position relative to their respective housings. The connector also includes alignments means associated with each housing for providing longitudinal alignment between the housings and their associated plug and receptacle. A sleeve means extends at least partially over both housings and is threadingly engaged with one of the housings for interlocking and maintaining engagement between the plug and receptacle when the sleeve is tightened. The plug and receptacle are preferably constructed of neoprene or the like material and are preferably engaged by a snap-fit assuring a water-proof connection. The outer housing is constructed in an explosion-proof manner and thus the total connector is in a sense double explosion-proof.

BRIEF DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
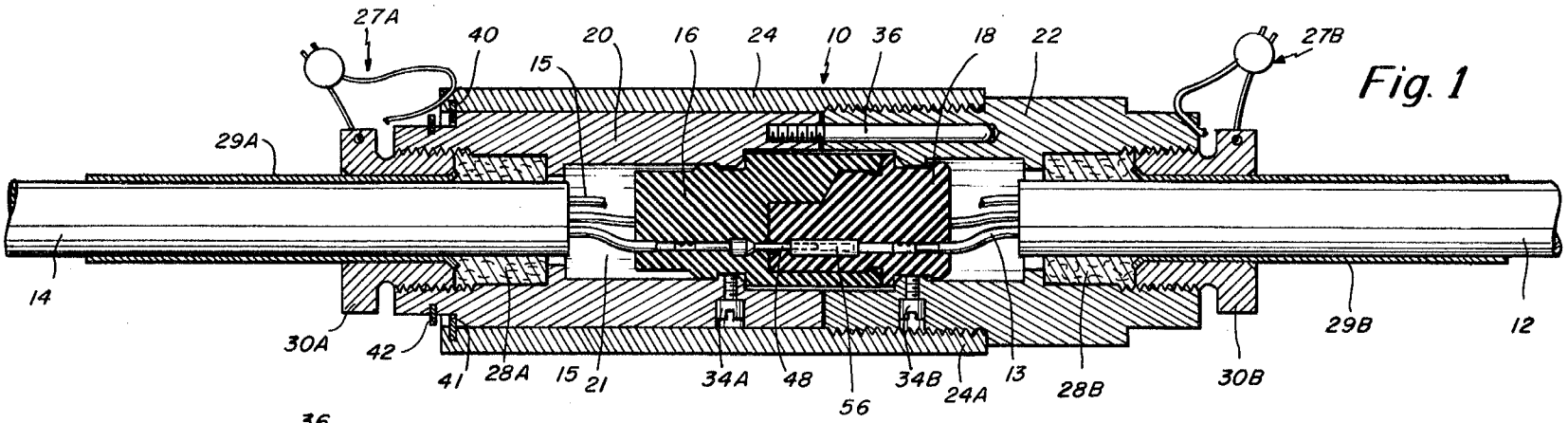
FIG. 1 is a longitudinal cross-sectional view through a preferred embodiment of the connector of this invention coupling between cable sections.
Figure 3:
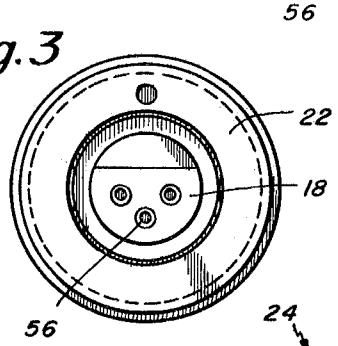
FIG. 3 is a further end view with the connector disassembled as viewed looking toward the plug housing.
Figure 2:
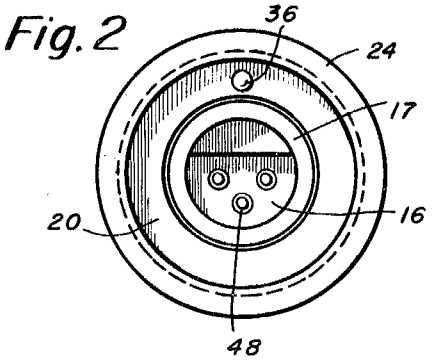
FIG. 2 is an end view with the connector disassembled as viewed into the receptacle housing including the locking sleeve.

The connector of this invention is a small, lightweight, water-proof, explosion-proof connector which may be used with many different types of cables, such as with an SO16-6 cable. The connector is used with a multi-wire cable and thus is a plural pin connector. In the disclosed embodiment, a three-pin connector is depicted. However, it is understood that other numbers of pins may be used such as a six-pin connector. Either a protective hose conduit or a wire weave type of cable support may be used. The connector is preferably provided with insertion and extraction tools which enable assembly of the connector.

The drawing shows the preferred embodiment of the invention in the form of a three-pin connector 10 for intercoupling cable sections 12 and 14. The cable 12 includes three insulated wires 13 and the cable section 14 similarly contains three insulated wires 15.

The connector basically comprises an insulative receptacle 16, an insulative plug 18, a receptacle housing 20, a plug housing 22, and a locking sleeve 24. Other components that comprise the connector include asbestos packing 28A, 28B, packing nuts 30A, 30B, locking screws 34A, 34B, dagger pin 36 and retaining rings 40 and 42.

Both the receptacle 16 and the plug 18 are preferably constructed of a neoprene material. The receptacle and plug are constructed so that they mate in essentially one position of relative rotation therebetween. These members are snap-fitted by means of the annular ridge 17 of the receptacle 16 which engages with the annular channel 19 of the plug 18. The receptacle 16 is locked in position in the passage 21 of the housing 20 by means of the locking screw 34A. Furthermore, the receptacle 16 is constructed with a channel 45 that interlocks with the annular ridge 46 extending inwardly from the housing 20. The ridge and channel arrangement prevents longitudinal movement of the receptacle relative to its housing and the locking screw 34A prevents rotational movement between the receptacle and its associated housing.

The receptacle receives each of the wires 15. Each of the wires is partially stripped to expose the center conductor which is attached to one of the contact pins 48. This attachment is preferably by means of crimping.

In a similar manner, the plug 18 is secured within the passage 23 of the plug housing 22 by means of the locking screw 34B. Furthermore, the plug is provided with a channel 50 that is snap fitted with the ridge 52 which is an annular ridge extending inwardly from the housing 22. This channel and ridge arrangement prevents longitudinal movement of the plug relative to its housing while the locking screw 34B prevents relative rotational movement therebetween.

The plug 18 contains passages for receiving the wires 13 of the cable 12. These wires are stripped at their ends to expose the inner conductor which is then secured to one of the contact sockets 56. This securing may be accomplished by means of crimping the wire to the contact socket 56. The passages in the plug and receptacle for receiving the sockets and pins properly positioned so that when the plug and receptacle are mated, the pins 48 properly mate with their associated sockets 56.

The housing 20 also receives the packing 28A and is internally threaded to receive the packing nut 30A. Similarly, the housing 22 receives the asbestos packing 28B and is internally threaded to receive the packing nut 30B. A flared tubing 29A is associated with nut 30A while a separate flared tubing 29B is associated with nut 30B. The flared tubings cover the section of the cable as it enters the connector.

Figure 4:
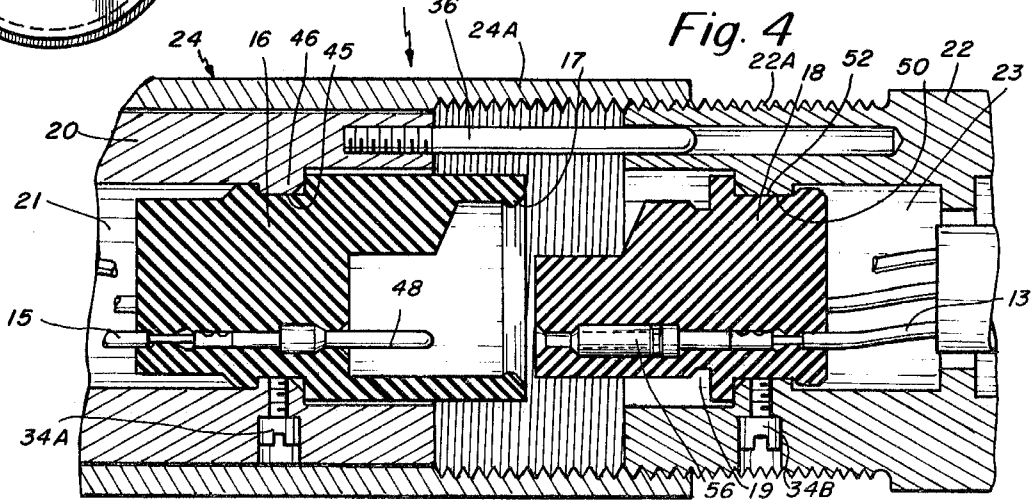
FIG. 4 is an enlarged fragmentary cross-sectional view similar to the view of FIG. 1 but with the connector parts partially separated.

The locking sleeve 24 is internally threaded at end 24A to engage with external threads 22A on the housing 22. A retaining ring 40 is received at an opposite end of the locking sleeve 24. This retaining ring 40 is urged against a shoulder 41 of the housing 20 when the locking sleeve 24 is tightened by being threaded with the externally threaded housing 22. FIG. 1 shows the connector in its finally assembled and locked position. FIG. 4 shows the connector only partially engaged. Actually, in FIG. 4 the connector is not electrically engaged but is partially mechanically engaged. FIG. 1 also shows wires seals 27A and 27B associated respectively with nuts 30A and 30B.

In assembling the connector of this invention an inch or more of the outer insulation jacket from both cables 12 and 14 is removed, thus exposing the wires 13 and 15 as depicted in FIG. 1. Each of the individual wires 13, 15 is then also stripped to expose about ¼ inch of bare center conductor. The stripped conductors are then inserted and crimped to their associated pin and socket contacts. Next, the nut 30A, tubing 29A, sleeve 24, and receptacle housing 20 are slid over the cable section 14 with the use of an insertion tool that is provided, the pin contacts 48 are inserted through the rear of the receptacle 16. When the pins snap in place, there will be approximately 5/16 inch of the pin will be protruding into the recess in the receptacle as indicated in FIG. 4. At this point, the receptacle 16 is free of its associated housing.

The next step is to slide the nut 30B, the tubing 29B and the housing 22 over the other section 12 of the cable. In a similar manner previously discussed with reference to the receptacle 16, an insertion tool is used to insert the socket contacts 56 into the rear of the plug 18 through the passages provided therein. The socket contacts, when finally snapped in place are in the position shown in FIG. 4 recessed into the plug approximately 3/32 inch. At this stage of the assembly the plug 18 is also not yet engaged firmly in the housing 22.

The next step is to mate the plug and receptacle so that they are totally engaged as depicted in FIG. 1. Next, the plug and receptacle assembly is snapped into the receptacle housing 20. In engaging the neoprene assembly in the housing 20, orientation arrows may be molded on the outer surface of the receptacle or both the plug and receptacle, and these arrows are to be aligned with the set screw 34A prior to final insertion. Once the receptacle 16 is snap fitted in place in its accommodated housing, then the screw 34A may be tightened. This locks the receptacle into the proper keying position.

The next step in assembly is to secure the plug 18 into its associated housing. This is accomplished by engagement of the locking sleeve 24 with the housing 22. The sleeve is screwed onto the plug housing until it is fully threaded as depicted in FIG. 1. This operation forces the neoprene plug 18 into its proper interlocked position in the housing 22 with the ridge 52 extending into the channel 50 of the plug. Thereafter, the sleeve 24 may be backed-off a few turns such as to the position shown in FIG. 4 until the set screw 34 is visible. This second set screw can then be tightened to hold the plug in its proper position. The locking sleeve can then again be tightened and the retaining ring 42 is inserted into an annular slot in the housing 20. The retaining ring 42 is used for separating the housings by virtue of the retaining ring 40 being urged thereagainst to separate the housing 20 from the housing 22 as the sleeve 24 is loosened. Finally, the packing 28A, 28B is inserted and the tubing 29A, 29B, and nuts 30A, 30B are inserted in place and tightened to tightly seal the packing about the cable. Finally, the wire seals 27A and 28B may be secured; the seal 27A extending from the plug 30A to the sleeve 24 and the seal 27B extending from the plug 30B to the housing 22.

Having described one embodiment of the present invention, it should now be apparent that numerous other embodiments are contemplated as falling within the scope of this invention. For example, a three-pin connector has been shown but obviously other multi-pin connectors such as a six-pin connector may be constructed with the principles of this invention. Also, the connector of this invention, because of its simplicity and because it can be made inexpensively may also form a relatively inexpensive means for splicing a cable. This also forms an explosion-proof cable splice.

What is claimed is:

1. An explosion-proof connector for coupling to sections of a multi-wire cable comprising;

an insulative receptacle for supporting male contact pins coupling to the wires of one section of cable, said receptacle having a cavity with the pins extending into the cavity terminating short of the end wall of the receptacle, an insulative plug for supporting female contact sockets coupling to the wires of another section of the cable, said plug having a protruding end matched to the receptacle cavity to fit tightly therewith in explosion-proof contact therebetween, the plug having the sockets imbedded therein, a receptacle housing for receiving the insulative receptacle, means for locking the receptacle in the receptacle housing in a fixed predetermined position relative to the receptacle housing including at least one locking screw, said receptacle housing having means for receiving said screw with the head of the screw accessible from external of said housing and recessed, means associated with said housings for providing rotational alignment therebetween, and sleeve means extending at least partially over both housings and threadingly engageable with one of said housings for causing and maintaining engagement between the plug and receptacle when the sleeve means is tightened, the sleeve means having threads at one end mating with threads of said one housing and means at the other end securing the sleeve means substantially stationary with the other housing, said sleeve means, in the tightened locked position, covering both locking screws associated with both housings.

2. An explosion-proof connector as set forth in claim 1 including an elongated passage in one housing for receiving an elongated dagger extending from the other housing and forming the means for longitudinal alignment.

3. An explosion-proof connector as set forth in claim 1 including means of both said plug and receptacle for limiting the plug and receptacle against longitudinal movement in their associated housings, said screws adapted to prevent relative rotational movement between plug and receptacle and associated housings.

4. An explosion-proof connector as set forth in claim 3 wherein said receptacle and associated housing have mating ridge and channel members for limiting relative longitudinal movement.

5. An explosion-proof connector as set forth in claim 4 wherein said plug and associated housing have mating ridge and channel members for limiting relative longitudinal movement.

6. An explosion-proof connector as set forth in claim 5 including packing means and a packing nut associated with each housing, said housings having through passages internally threaded to receive the packing nut, and a flared tube associated with each housing about the cable section and having its flared end intermediate the nut and packing.

7. An explosion-proof connector as set forth in claim 1 including a retaining ring on the other end of the sleeve means for urging against a shoulder on one of said housings.

8. An explosion-proof connector as set forth in claim 7 including a second retaining ring on said one housing for engagement with said first ring.

* * * * *